US006669527B2

(12) United States Patent
Tai Chan

(10) Patent No.: US 6,669,527 B2
(45) Date of Patent: Dec. 30, 2003

(54) DOLL OR TOY CHARACTER ADAPTED TO RECOGNIZE OR GENERATE WHISPERS

(75) Inventor: Albert Wai Tai Chan, Taipei (TW)

(73) Assignee: Thinking Technology, Inc., Nassau (BH)

( * ) Notice: Subject to any disclaimer, the term of this patent is extended or adjusted under 35 U.S.C. 154(b) by 0 days.

(21) Appl. No.: 10/033,885

(22) Filed: Jan. 3, 2002

(65) Prior Publication Data

US 2002/0086607 A1 Jul. 4, 2002

Related U.S. Application Data

(60) Provisional application No. 60/259,594, filed on Jan. 4, 2001.

(51) Int. Cl.[7] ..... A63H 30/00
(52) U.S. Cl. ..... 446/175; 446/297
(58) Field of Search ..... 446/297, 299, 446/300, 302, 303, 397, 408, 484, 142, 175, 416; 34/308, 322, 309, 335, 393

(56) References Cited

U.S. PATENT DOCUMENTS 4,799,171 A * 1/1989 Cummings ..... 364/513.5
4,950,200 A * 8/1990 Curran ..... 446/302
5,376,038 A * 12/1994 Arad et al. ..... 446/297
5,468,172 A * 11/1995 Basile ..... 446/299
5,651,716 A * 7/1997 Mowrer et al. ..... 446/301
5,668,780 A * 9/1997 Hsieh ..... 367/198
6,315,631 B1 * 11/2001 Beckman et al. ..... 446/297
6,380,844 B2 * 4/2002 Pelekis ..... 340/5.8

* cited by examiner

*Primary Examiner*—Jacob K. Ackun
*Assistant Examiner*—Jamila Williams
(74) *Attorney, Agent, or Firm*—Kramer & Amado, P.C.; Gordon J. Zimmerman, Esq.

(57) ABSTRACT

An interactive electronic doll or toy character comprises receiving means to receive and distinguish normal human speaking voices from whispered human speaking voices, and communication means to communicate to the human speaker that either a normal or a whispered voice has been recognized. The doll or toy character may also comprise sound generation means by which simulated whispered human speech may be generated, and trigger means located on the doll or toy character to trigger the generation of such speech. Normal speech and other sounds can also be generated by the doll of the invention.

20 Claims, 6 Drawing Sheets

FIG. 6A.
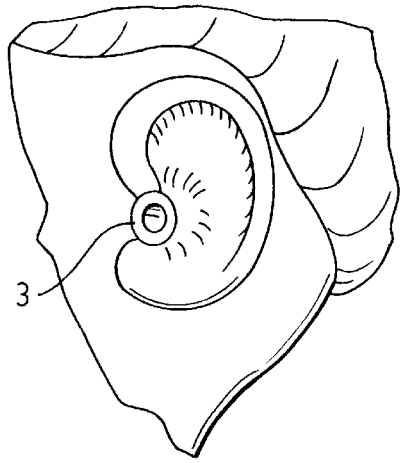
FIG. 6B.
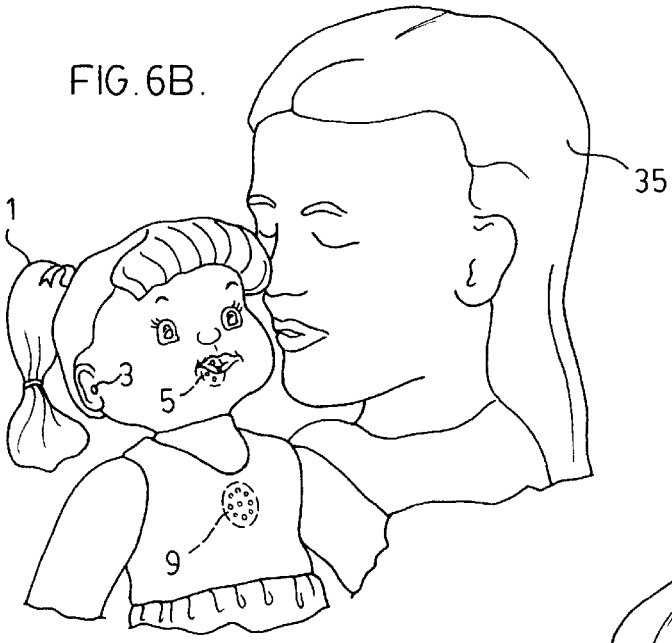
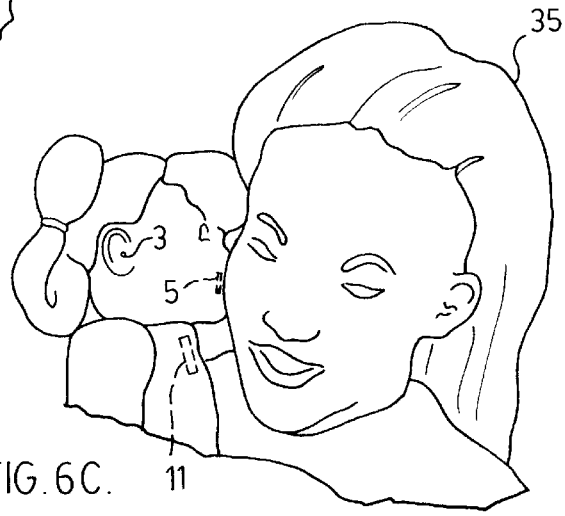
FIG. 6C.

DOLL OR TOY CHARACTER ADAPTED TO RECOGNIZE OR GENERATE WHISPERS

This application claims the benefit of Provisional Application No. 60/259,594, filed Jan. 4, 2001.

BACKGROUND

Dolls which can generate simulated human noises or speech are known. In order to increase the enjoyment of a user when playing with a doll, however, it would be an advantage if the doll were able to respond to whispered speech by the user, typically a child, and moreover to detect and distinguish the child's whispered speech from other sounds like speech at normal volumes. It would further be advantageous if the doll or toy character could appear to whisper to the child in appropriate circumstances. Moreover, it would be most advantageous if the doll or toy character could both appear to whisper to a user, such as a child, and recognize whispered speech generated by that child, as well as non-whispered speech, and respond appropriately.

SUMMARY OF THE INVENTION

Accordingly, in an aspect of this invention, an interactive electronic doll or toy character comprises receiving means to receive and distinguish normal human speaking voices from whispered human speaking voices, and communication means to communicate to the human speaker that either a normal or a whispered voice has been recognized.

In further aspects of the invention:

(a) the receiving means comprises a microphone mounted on or in the doll in the vicinity of an ear of the doll;

(b) the receiving means comprises microphones mounted on or in the doll in the vicinity of each ear of the doll;

(c) the receiving means comprises sound conversion means adapted to convert a voice input from sound to electronic signals of a character determined by the volume of said voice input, and a microprocessor adapted to interpret said electronic signals and to generate an appropriate response;

(d) the communication means comprises sound generating means adapted to mimic human speech;

(e) the sound generating means comprises a first audio speaker adapted to mimic whispers, and a second audio speaker adapted to mimic normal volume speech.

In a further aspect, the electronic doll or toy character comprises sound generation means by which simulated whispered human speech may be generated, and trigger means located on the doll or toy character to trigger the generation of such speech.

In further aspects of the invention:

(a) the sound generation means comprises an integrated circuit chip comprising a series of pre-recorded phrases, and an audio speaker adapted to receive signals from said integrated circuit chip;

(b) the trigger means comprises a pressure-activated switch adapted to be activated by the user's touch;

(c) the trigger means comprises a photo sensor adapted to be activated by the touch or proximity of the user;

(d) the audio speaker is mounted in or near the mouth of the doll or toy character;

(e) the audio speaker is mounted behind the mouth of the doll, and sound generated by the speaker is conducted to the opening of said mouth through a sound chamber;

(f) the electronic components are powered by an electrical storage battery;

(g) the doll or toy character further comprises a timer, wherein following a delay in activity of the doll or toy character of a pre-selected duration as measured by the timer, electrical power to said electronic components is interrupted;

(h) the doll or toy character further comprises a manually operated sleep switch to initiate flow of electrical power to the electronic components after said power flow has been interrupted.

In a further aspect, the interactive doll or toy character comprises sound generation means by which simulated whispered human speech may be generated, and sensor means located in or near the mouth of the doll or toy character adapted to detect the presence of a human body close to said doll's mouth, and to generate a signal to trigger said sound generation means, such that when a user places a portion of the user's body in close proximity to the doll's mouth, said simulated whispered human speech is generated.

In further aspects of said invention:

(a) the volume of the simulated whispered human speech is selected so that it will be audible only if the user's ear is in the vicinity of the doll's mouth;

(b) the sensor means comprises a short range audio frequency signal adapted to be modified by the impedance of a human body in the immediate vicinity thereof;

(c) the audio frequency signal is generated from a series of linked integrated circuits, operating with inverter functions.

In a further aspect, the interactive electronic doll or toy character comprises receiving means to receive and distinguish non-whispered human speaking voices from whispered human speaking voices, first sound generation means by which simulated whispered human speech may be generated, and a first series of pre-recorded whispered phrases adapted to be reproduced by said sound generation means, such that the doll or toy character may communicate to a user whether a non-whispered voice or a whispered voice has been detected by means of simulated whispered human speech.

In a further aspect, said doll or toy character further comprises second sound generation means by which simulated non-whispered human speech may be generated, and a second series of pre-recorded, non-whispered phrases adapted to be reproduced by said second sound generation means, such that the doll or toy character may additionally communicate to a user whether a whispered or non-whispered voice has been detected by means of simulated non-whispered human speech.

In further aspects of the invention:

(a) said first sound generation means comprises a first audio speaker in or near the doll's mouth, and said second sound generation means comprises a second audio speaker remote from the doll's mouth;

(b) the receiving means comprises a short range sensor functioning by means of a short range audio frequency signal adapted to be modified by the impedance of a human body in the immediate vicinity thereof.

Further aspects of the invention will become apparent from the following description of a preferred embodiment thereof.

BRIEF DESCRIPTION OF THE DRAWINGS

A preferred embodiment of the invention is illustrated by the attached drawings, wherein:

FIGS. 6A, 6B and 6C are perspective, schematic views illustrating components of the invention and use of the invention.

DETAILED DESCRIPTION OF THE INVENTION

Figure 1:
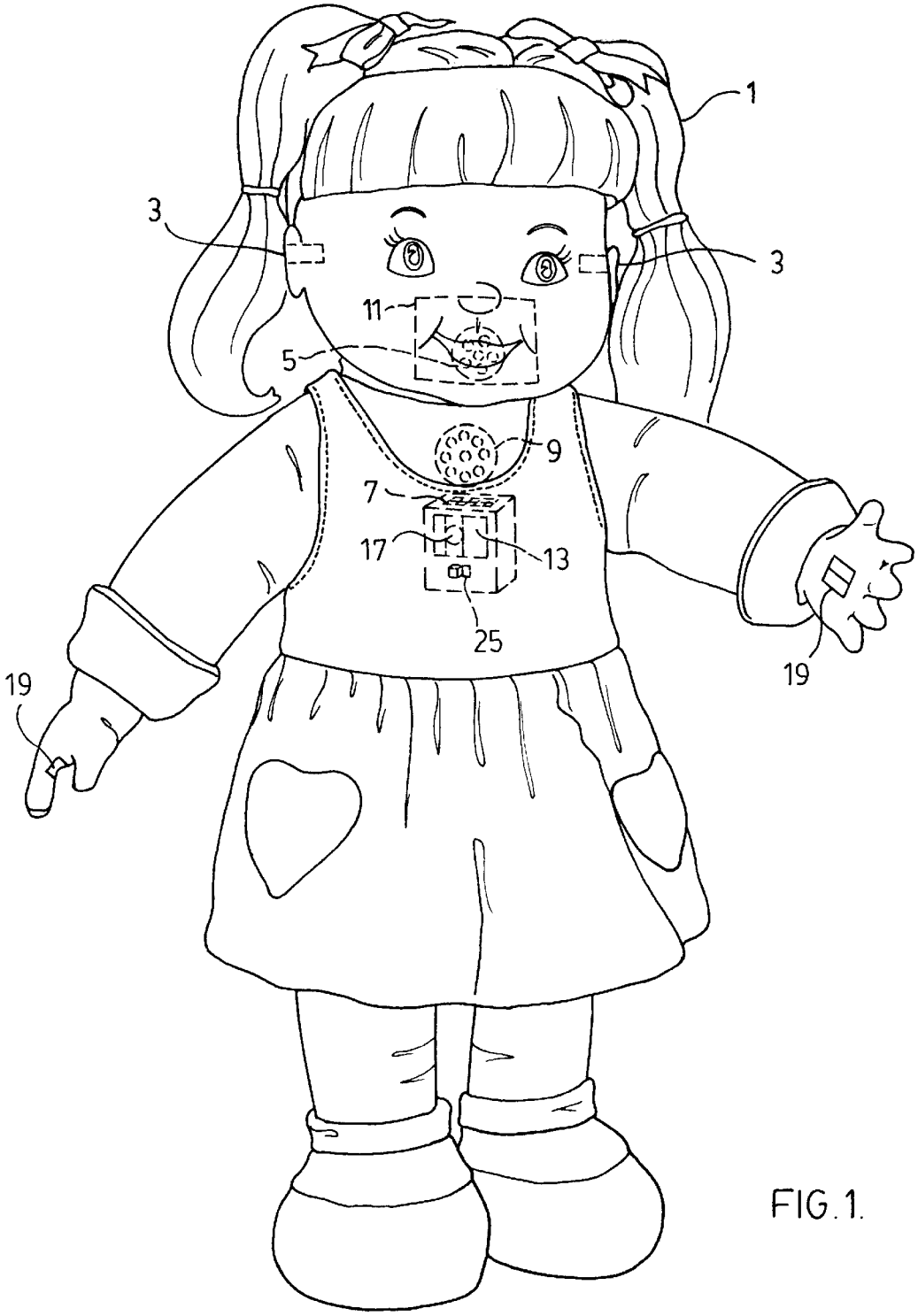
FIG. 1 is a perspective, schematic view illustrating elements of the invention.

A doll or toy character is adapted to generate simulated whispered speech, to receive and recognize human whispered speech, or to perform both functions.

In a preferred embodiment, a doll comprises a sensor mounted in or near the mouth of the doll adapted to sense the presence of a person in the near vicinity. The purpose of the sensor is to detect when, preferably, the user of the doll places his or her ear close to the mouth of the doll. Various sensors may be used for this purpose. It has been found that a sensor which is affected by the impedance offered by the human body may be quite effective in this regard. For example, a series of linked integrated circuits operating with inverter functions may be used to generate an audio wave of low frequency. Such a wave is subject to being modified by the impedance of the human body when the body closely approaches the source of the waves.

The sensor is connected to a microprocessor and can send a signal to the microprocessor when it appears that a person is in close range to receive a simulated whisper from the doll. An audio speaker located in or near the mouth of the doll can generate the actual sound of simulated whispered human speech under the control of the microprocessor. The microprocessor, which may comprise integrated circuit chips, can be pre-programmed with a series of appropriate whispered comments. If desired, the speaker can be recessed from the opening of the mouth in order to allow the sound from the speaker to pass through a sound chamber or tube. In this way, the sound may be muffled or softened to more closely simulate whispered speech.

The doll may be provided with sensors or switches to stimulate the doll to generate simulated whispers. The whispers may be generated whether or not the ear of the person is close to the sensor near the mouth of the doll. The volume of the whispered speech, however, will probably not be sufficient to allow a user of the doll to make out the words spoken by the doll unless the user's ear is close to the doll's mouth. Mechanical switches can be placed, for example, in the hands of the doll in order to initiate speech by the doll. These switches may be used to initiate whispered speech, or non-whispered speech as more fully discussed below. Alternatively, photo sensors can be placed on the doll, such as in the hands of the doll, in order to initiate a response from the doll. When the photo sensors are covered by a portion of the hand of the user, whispered speech can begin. The locating of the switches or sensors in the hands of the doll has the added advantage of making it appear that the doll whispers to the user when the doll and user are holding hands.

The doll can also be adapted to recognize human speech and to distinguish normal, non-whispered speech, from whispers. The doll may be provided with a microphone, or multiple microphones, most conveniently placed in or near the ears of the doll. In this way, it will appear that the doll hears speech spoken directly into its ears. The microphones convert the sound of the human speech to electrical signals which will vary depending upon the volume of the speech detected. These signals are sent to a microprocessor which determines whether whispered or non-whispered speech has been detected, and generates a response accordingly. In the preferred embodiment, upon receiving a whisper from the user, the doll will prompt the user to place his or her ear near the doll's mouth in order to receive another whispered secret from the doll.

The interest created by the doll can be increased by allowing it to operate in more than one mode. This can be accomplished by the use of audio speakers, and pre-programmed responses, appropriate to both whispered and non-whispered simulated speech. In this case, it will be appropriate to place a speaker adapted to generate simulated non-whispered speech at a location remote from the mouth of the doll, such as in or near the doll's stomach area. In this way, when the user is positioned at some distance from the doll, without the user's head next to the doll's mouth, the sound from the second audio speaker will appear to emanate from the doll generally. The position of speakers also provides a feature for the convenience and comfort of the user of the doll. It might be uncomfortable for the user of a doll to have his or her ear close to the mouth of the doll if a relatively loud signal were to be generated by the audio speaker in or near the mouth of the doll. Thus, it is an advantage to make the speaker in the doll's mouth dedicated to reproducing simulated whispered speech, while leaving the other speaker remote from the doll's mouth to generate louder simulated speech. Thus, even if the user's ear is next to the mouth of the doll, sounds emitted from the other speaker will not enter directly into the ear of the user, which could otherwise cause discomfort.

The electronic components of the doll are preferably powered by one or more electrical storage batteries. In order to preserve battery power, a number of features are possible. For example, a main power switch can be provided which can be switched to the "off" mode to prevent any power use from the storage batteries. When the power switch is in the "on" position, electrical power will be provided unless otherwise interrupted by one of the battery saving features. In a third position of the main power switch, the "try me" position, the toy operates in a mode intended for in-store use prior to sale of the doll. In this mode, the user can press a button on the doll in order to generate certain of the prerecorded sounds, either in the normal voice, or in the whispered voice. Since the sounds are generated without the requirement for power being routed to the sensors, less battery power is used. In addition, the battery power shuts off automatically after a short period of time when the doll is operated in this mode.

The control unit of the doll may be provided with an electronic timer. Even when the main power switch is in the "on" position, if no activity is generated for a predetermined period of time, the doll can be placed into the "sleep" mode. In this mode, some activity is required in order to restart the flow of power to the electronic components. This could be by the pressing of a button, such as a "talk button". The same talk button can be used to generate simulated doll speech when the doll is in the "try me" mode. By pressing such a button, a series of comments or prompts from the doll can be generated.

When operating in a preferred mode, if the user speaks loudly into the microphone, the doll may be prompted to request a softer voice input. If, on the other hand, the voice input is too soft, the doll can generate a response to request a louder voice input. When the voice input is at a decibel level pre-selected as being appropriate for whispered speech, the doll can issue a response indicating that it is satisfied with the response, and that secrets are being shared. The doll can request further whispered secrets, and invite the user to come closer to receive a whispered secret from the doll.

On the other hand, if no whisper is detected, or if the user continues to talk at a non-whisper volume, the doll may be programmed to issue generic phrases or phrases designed to encourage further "secret" play and the exchange of whispers.

The doll may also be programmed to generate other sounds, such as singing through the secondary (i.e. non-whisper) speaker.

FIG. 1 illustrates various components of the invention. A doll or toy character (1) comprises receiving means (3), in this case microphones, adapted to receive the sound of human voices. A speaker (5) is adapted to generated whisper sounds form the doll in response to an appropriate stimulus of the receiving means (3). Speaker (5) operates under the control of an integrated circuit (7) which is pre-programmed to produce various pre-recorded human speech segments, or other sound effects. A secondary speaker (9) located remote from the mouth of the doll (1) is adapted to produce non-whispered speech, also pre-recorded on the integrated circuit (7). Whether whispered speech will be generated from the speaker (5), or ordinary speech will be generated from speaker (9), depends upon the stimulus received at either or both of microphones (3).

An interesting feature of a preferred embodiment of the invention is the use of a sensor (11). The sensor is adapted to distinguish the presence of a human body in the immediate vicinity, as previously described. For example, sensor (11) may be affected by the impedance offered by a human body. Other forms of sensor known in the art may also be employed.

The electronic components of the doll or toy character are typically powered by electrical storage batteries (13).

Figure 2:
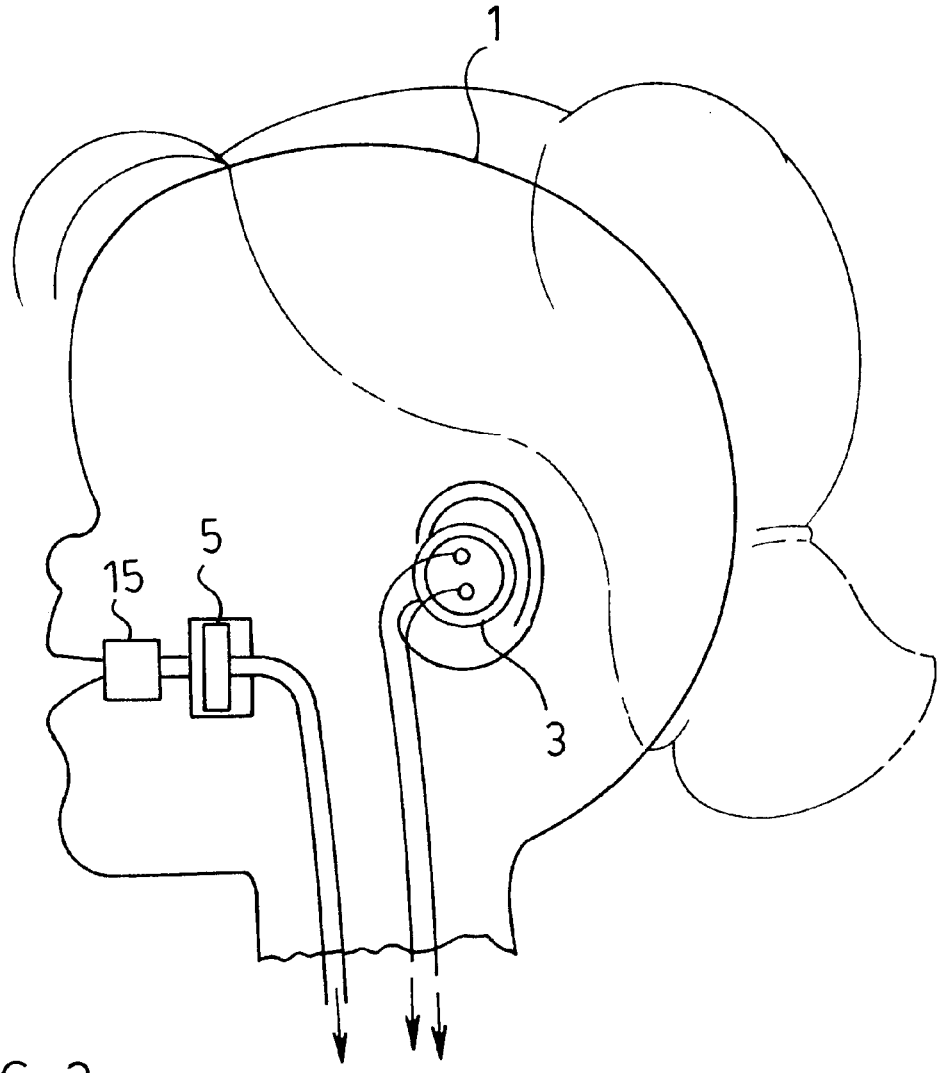
FIG. 2 is a schematic, cross-sectional view showing elements of the sound receiving and sound generation means of an embodiment of the invention.

Referring to FIG. 2, microphone (3) receives a voice signal. Depending upon the volume of the signal, it is interpreted as being either a whisper, or normal speech by the integrated circuit microprocessor (not shown in FIG. 2). Appropriate signals from the integrated circuit are then forwarded to speaker (5) located behind the mouth of the doll. In order to soften the sound or create a more lifelike whisper sound, a sound tube (15) may be placed between the speaker and the exterior of the doll.

Returning to FIG. 1, push button (17) may be used to in order to trigger the "try me" feature of the toy for in store use, as previously described.

Figure 3:
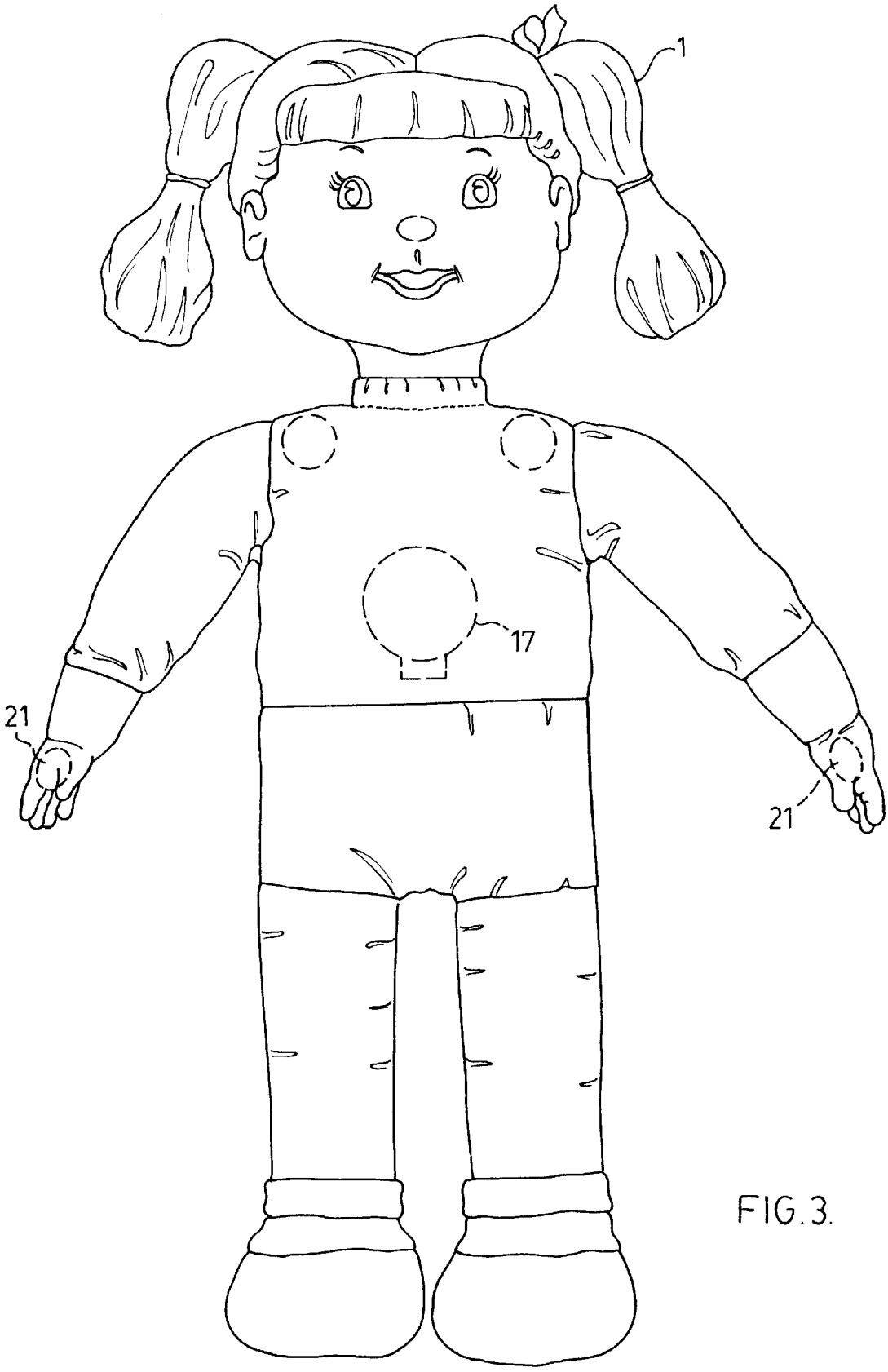
FIG. 3 is a front elevation view illustrating elements of the invention.

Photosensors (19) located in the hands of the doll or toy character are connected to the integrated circuit microprocessor. In a preferred embodiment, when a hand of a user is placed on or near a photosensor (19), a signal may be generated to commence a sequence of pre-recorded comments from the doll. Referring to FIG. 3, instead of using photosensors, pressure sensitive buttons (21) may be used.

Figure 5:
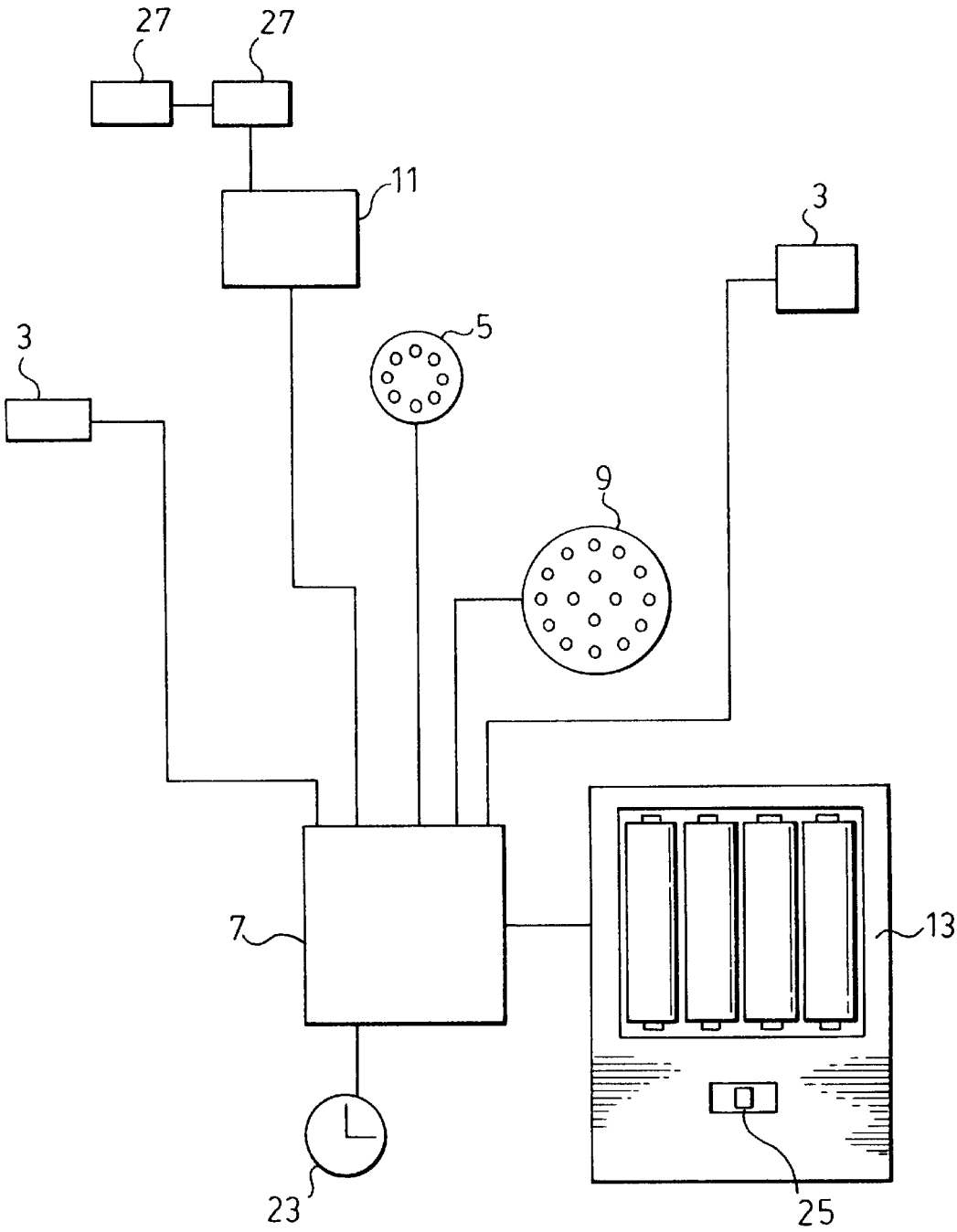
FIG. 5 is a schematic representation of various components of the invention.

Referring to FIG. 5, the various components of the invention are illustrated schematically. Timer (23) may control an automatic shut down of the system after a delay of a certain length. This timer is typically used to preserve battery life. Switch (25) is used to turn the electrical power off, or to place the doll in the "try me" mode for in store-use, or the "play" mode after the toy is removed from its packaging.

Figure 4:
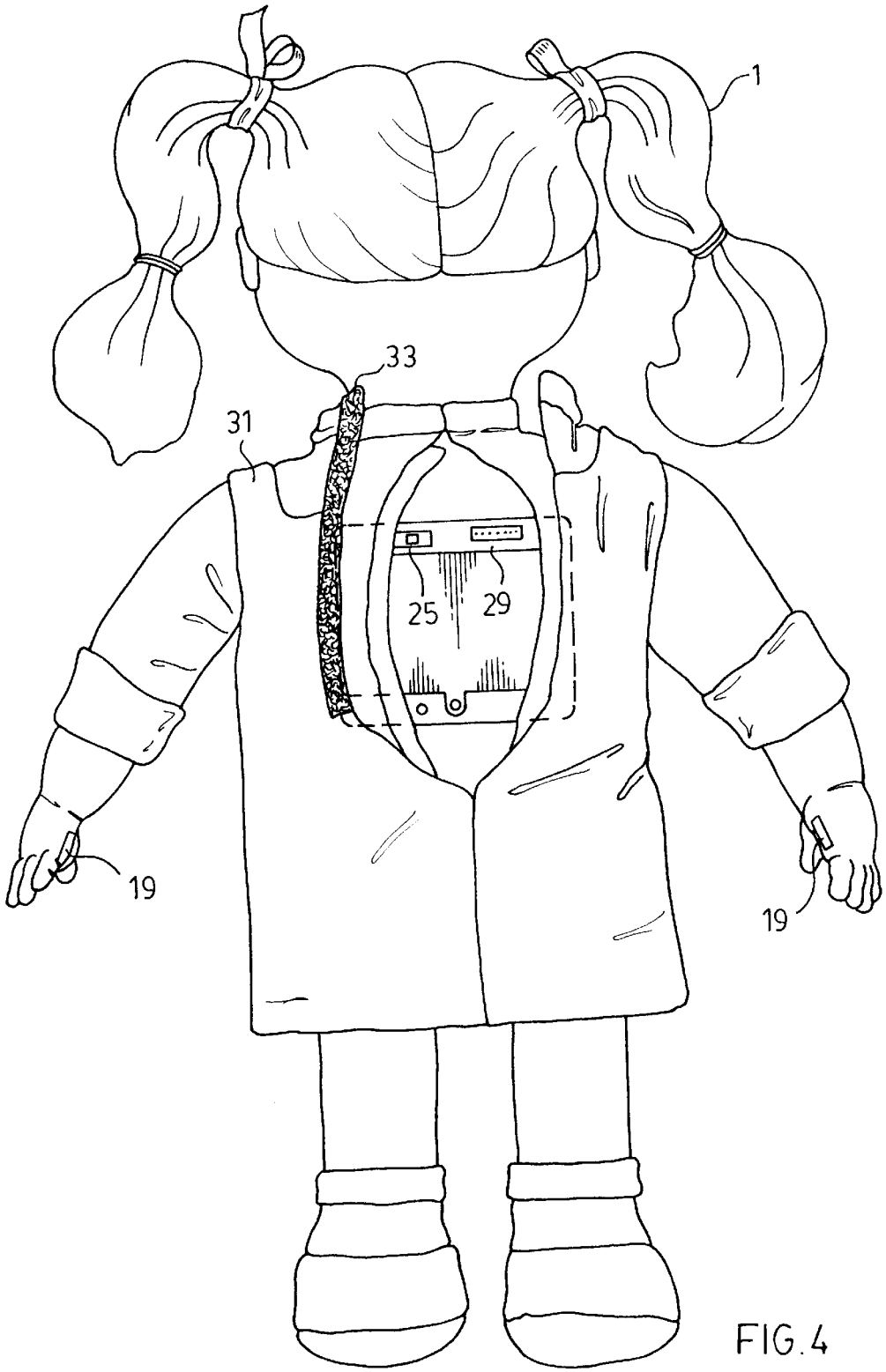
FIG. 4 is a rear elevation view illustrating elements of the invention.

Linked integrated circuits (27) operating with inverter functions are used to generate an audio wave of low frequency for sensor (11). Such audio waves are subject to being modified by the impedance of the human body when such a body closely approaches the source of the waves. Referring to FIG. 4, connector port (29) is used to connect the doll with hard wiring when the "try me" mode is in place. The wires are removed when the doll is removed from the packaging. Clothing (31) may be provided with a recloseable strip of material (33) to provide access to control switch (25) and to electrical storage batteries (13). The electrical storage batteries will require changing from time to time as electrical power is used during operation of the doll or toy character.

FIGS. 6A, 6B and 6C illustrate the approach of a human to the doll in order to whisper into an ear of the doll comprising a microphone (3). The user (35) alters his or her speech until the doll or toy character receives a soft enough volume of speech to recognize it as a whisper, under the control of the microprocessor. Then, the user places the mouth of the doll or toy character close to the user's ear. In this position, the presence of the user in the immediate vicinity of the doll is detected by sensor (11) and whispered sounds are generated from speaker (5) under the control of the integrated circuit (7). See FIG. 5.

Although a preferred embodiment of the invention has been described, variations from the preferred embodiment will be apparent to those skilled in the art, and are intended to be encompassed by the invention.

I claim:

1. An interactive electronic doll or toy character comprising:

(a) receiving means to receive and distinguish normal human speaking voices from whispered human speaking voices; and (b) communication means to communicate to the human speaker that either a normal or a whispered voice has been recognized.

2. The interactive electronic doll or toy character of claim 1, wherein the receiving means comprises a microphone mounted on or in the doll in the vicinity of an ear of the doll.

3. The interactive electronic doll or toy character of claim 1, wherein the receiving means comprises microphones mounted on or in the doll in the vicinity of each ear of the doll.

4. The interactive electronic doll or toy character of claim 1, wherein the receiving means comprises sound conversion means adapted to convert a voice input from sound to electronic signals of a character determined by the volume of said voice input, and a microprocessor adapted to interpret said electronic signals and to generate an appropriate response.

5. The interactive electronic doll or toy character of claim 1, wherein the communication means comprises sound generating means adapted to mimic human speech.

6. The interactive electronic doll or toy character of claim 5, wherein the sound generating means comprises a first audio speaker adapted to mimic whispers, and a second audio speaker adapted to mimic normal volume speech.

7. An interactive electronic doll or toy character comprising:

(a) sound generation means by which simulated whispered human speech may be generated; and (b) a photo-sensor located on the doll or toy character and adapted to be activated by the touch or proximity of a user to trigger the generation of such speech;

such that when a user activates the photo-sensor, simulated human speech is generated by the doll or toy character to prompt the user to take further action.

8. The interactive electronic doll or toy character of claim 7, wherein the sound generation means comprises an integrated circuit having a series of pre-recorded phrases, and an audio speaker adapted to receive signals from said integrated circuit.

9. The interactive electronic doll or toy character of claim 7, wherein the audio speaker is mounted in or near the mouth of the doll or toy character.

10. The interactive electronic doll or toy character of claim 7, wherein the audio speaker is mounted behind the mouth of the doll, and sound generated by the speaker is conducted to the opening of said mouth through a sound chamber.

11. The interactive electronic doll or toy character of claim 7, wherein the integrated circuit is powered by electrical storage batteries.

12. The interactive electronic doll or toy character of claim 11, further comprising a timer, wherein following a delay in activity of the doll or toy character of a pre-selected duration as measured by the timer, electrical power to said electronic components is interrupted.

13. The interactive electronic doll or toy character of claim 12, further comprising a manually operated switch to initiate flow of electrical power to the integrated circuit after said power flow has been interrupted.

14. An interactive electronic doll or toy character comprising:

(a) sound generation means by which simulated whispered human speech may be generated; and (b) sensor means located in or near the mouth of the doll or toy character adapted to detect the presence of a human body close to said doll's mouth, and to generate a signal to trigger said sound generation means;

such that when a user places a portion of the user's body in close proximity to the doll's mouth, said simulated whispered human speech is generated.

15. The interactive electronic doll or toy character of claim 14, wherein the volume of the simulated whispered human speech is selected so that it will be audible only if the user's ear is in the vicinity of the doll's mouth.

16. The interactive electronic doll or toy character of claim 14, wherein the sensor means comprises a short range audio frequency signal adapted to be modified by the impedance of a human body in the immediate vicinity thereof.

17. The interactive electronic doll or toy character of claim 16, wherein the audio frequency signal is generated from a series of linked integrated circuits, operating with inverter functions.

18. An interactive electronic doll or toy character comprising:

(a) receiving means to receive and distinguish non-whispered human speaking voices from whispered human speaking voices;

(b) first sound generation means by which simulated whispered human speech may be generated; and (c) a first series of pre-recorded whispered phrases adapted to be reproduced by said sound generation means;

such that the doll or toy character may communicate to a user whether a non-whispered voice or a whispered voice has been detected by means of simulated whispered human speech.

19. The interactive electronic doll or toy character of claim 18, further comprising:

(a) second sound generation means by which simulated non-whispered human speech may be generated; and (b) a second series of pre-recorded non-whispered phrases adapted to be reproduced by said second sound generation means;

such that the doll or toy character may additionally communicate to a user whether a whispered or non-whispered voice has been detected by means of simulated non-whispered human speech.

20. The interactive electronic doll or toy character of claim 19, wherein said first sound generation means comprises a first audio speaker in or near the mouth of the doll or toy character, and said second sound generation means comprises a second audio speaker remote from the mouth of the doll or toy character.

* * * * *